United States Patent [19]

Olsson

[11] Patent Number: 4,614,492

[45] Date of Patent: Sep. 30, 1986

[54] BURNER FOR BURNING PULVERULENT FUEL

[75] Inventor: Sten Y. Olsson, Gothenburg, Sweden

[73] Assignee: Ingeniorsfirman Petrokraft AB, Gothenburg, Sweden

[21] Appl. No.: 701,119

[22] Filed: Feb. 13, 1985

[30] Foreign Application Priority Data

Feb. 13, 1984 [SE] Sweden ..... 8400738

[51] Int. Cl.[4] ..... F23D 1/00; F23Q 9/00

[52] U.S. Cl. ..... 431/284; 431/183; 431/187; 110/265

[58] Field of Search ..... 431/115, 183, 185, 187, 431/284; 110/261, 263, 265

[56] References Cited

U.S. PATENT DOCUMENTS

| | | | |
|---|---|---|---|
| 1,910,735 | 5/1933 | Zikesch | 431/284 X |
| 1,910,893 | 5/1933 | Frisch | 431/185 |
| 2,335,188 | 11/1943 | Kennedy | 431/284 |
| 2,973,727 | 3/1961 | Northcote | 431/284 X |
| 3,327,762 | 6/1967 | Saha | 431/183 X |
| 3,827,851 | 8/1974 | Walker | 431/175 |
| 3,894,834 | 7/1975 | Estes | 431/174 |
| 4,431,403 | 2/1984 | Nowak et al. | 431/183 |

FOREIGN PATENT DOCUMENTS

| | | | |
|---|---|---|---|
| 1007931 | 5/1957 | Fed. Rep. of Germany | 110/263 |
| 2816674 | 10/1979 | Fed. Rep. of Germany . | |
| 1576345 | 10/1980 | France . | |
| 930959 | 7/1963 | United Kingdom | 431/183 |
| 2057114 | 3/1981 | United Kingdom . | |
| 2085575 | 4/1982 | United Kingdom . | |
| 2089963 | 6/1982 | United Kingdom . | |
| 2093979 | 9/1982 | United Kingdom . | |
| 2118711 | 11/1983 | United Kingdom . | |

*Primary Examiner*—Larry Jones
*Assistant Examiner*—Allen J. Flanigan
*Attorney, Agent, or Firm*—Merchant, Gould, Smith, Edell, Welter & Schmidt

[57] ABSTRACT

A burner for burning a pulverulent fuel has a divergent burner quarl at the narrow end of which a pressure liquid or compressed air burner for combustion-assisting gaseous or liquid fuel opens. The feed means for the pulverulent fuel comprise a number of separate discharge passages which are arranged in a ring and which open in the divergent wall portion of the burner quarl at a distance from both the burner nozzle and the inlet for secondary or main combustion air and which are directed obliquely inwardly towards the axis of the burner and are spaced from each other a distance which substantially exceeds the extension of each outlet of the discharge passage along said ring.

4 Claims, 2 Drawing Figures

BURNER FOR BURNING PULVERULENT FUEL

Figures 1, 2:
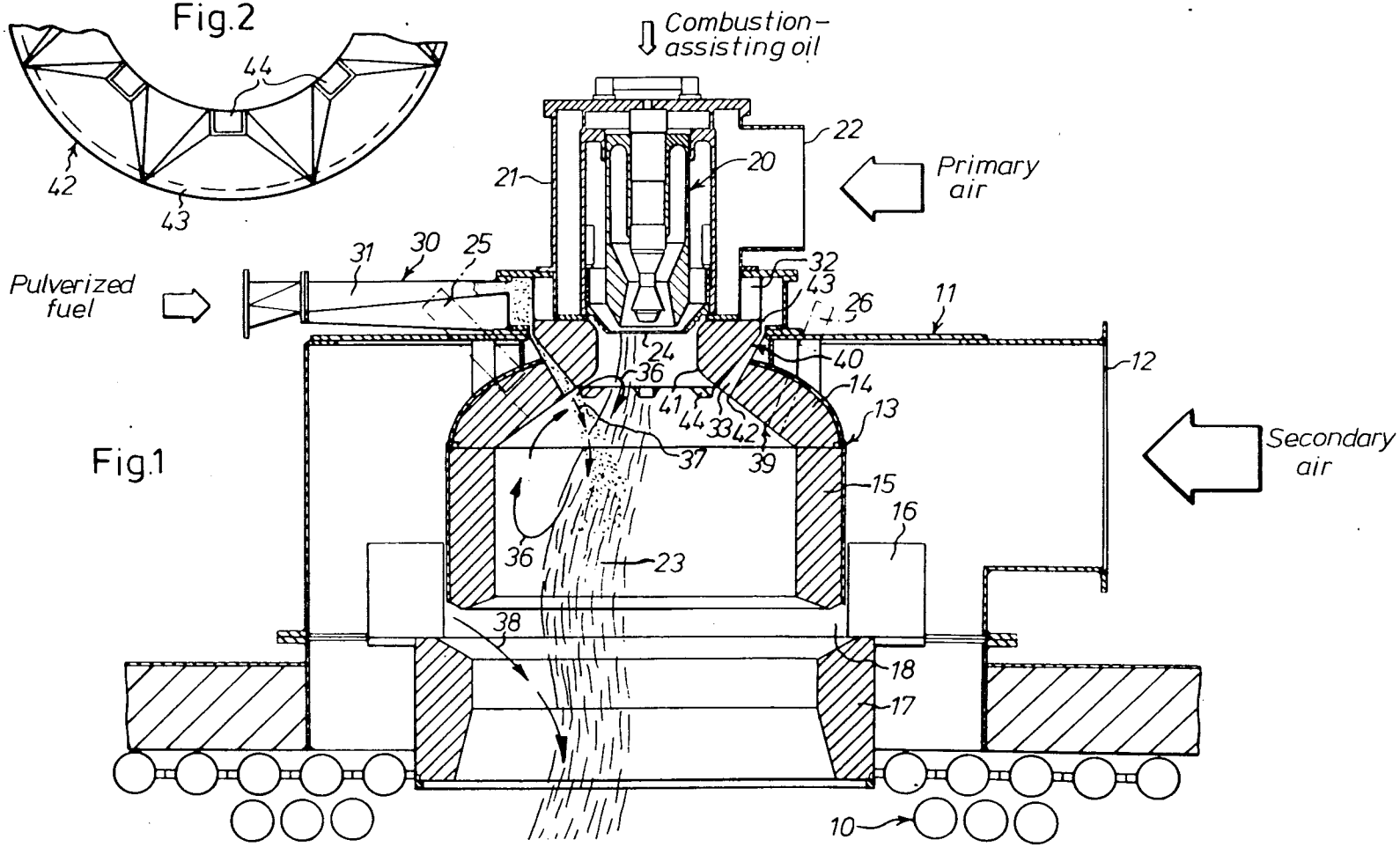

The present invention relates to a burner for burning a pulverulent fuel, using a combustion-assisting flame produced by means of liquid or gaseous fuel, said burner having a divergent burner quarl in which feed means for injecting the pulverulent fuel, a pressure liquid or compressed air burner for combusting the combustion-assisting gaseous or liquid fuel, and a primary air inlet open and adjacent the outer end of which an inlet for secondary or main combustion air opens, the burner nozzle of said pressure liquid or compressed air burner being disposed at the narrow end of the divergent burner quarl.

Firing of pulverized coal or pulverized biofuel in suspension in air generally requires special devices for maintaining a sufficiently high flame temperature to obtain an acceptable complete combustion of the supplied fuel within a given furnace chamber volume (residence time in furnace chamber). Therefore, in burners for burning pulverulent fuels use has been made of various auxiliary means, such as devices for preheating the combustion air and/or the carrier air for the pulverulent fuel, additional brickwork in the furnace chamber, devices for combustion-assisting firing with other easily combustible fuels, such as oil or gas, and specially designed furnace chambers with brickwork.

British patent specification GB-A No. 2,085,575 discloses a burner construction which is of the above-mentioned type and which has an annular gap for supplying an air-borne suspension of pulverulent fuel. In this known burner, the annular fuel supply nozzle is disposed outside the secondary air supply nozzle, which gives rise to problems in that the pulverulent fuel is fed into the secondary air flow which has a relatively low temperature. As a result, the powder will not be ignited in an efficient manner and, moreover, it has been found that burners of this design cannot be used in or at least suffer from a poor performance in large-size furnace chambers. In tests performed in this known construction with up to as much as 95% of combustion-assisting fuel (oil) and only 5% pulverized coal, no satisfactory ignition of the powder has been achieved. With this burner installed in so-called fire-tube boilers, better results have however been achieved in that the flame produced is kept together in such a tubular furnace chamber and the powder is maintained in the flame.

British patent specification GB-A No. 2,093,979 shows in FIGS. 3 and 4 another known burner for pulverulent fuels in which two igniting dust fuel suspensions are supplied around a centrally disposed gas burner, one of the igniting fuel suspensions being supplied through a number of separate inlets which are arranged in a ring and are axially directed and interposed between outlets for the main more coarse-grained pulverulent fuel. According to this patent specification, the arrangement is intended to permit penetration of secondary air into the remaining areas between the different axial inlets for the igniting powdery fuel. In this case, too, there are difficulties because the igniting powdery fuel and the main powdery fuel will come into contact with the secondary air before being mixed with the combustion-assisting flame.

British patent specification GB-A No. 2,089,963 discloses another known burner construction in which use is made of an annular nozzle for supplying the powdery fuel suspension. This known burner suffers from the above-mentioned shortcomings.

British patent specification GB-A No. 1,576,345 discloses yet another known burner construction in which the pulverulent fuel is supplied through an annular nozzle.

British patent specification GB-A No. 2,118,711 discloses a burner construction in which a number of nozzles for secondary air are arranged outside the burner flame. According to this patent specification, the arrangement assists in heating the powder by recirculation of hot gas into the air. This may lead to a decrease of the oxygen concentration in the outer layer of the flame and may delay or retard the combustion of the powdery fuel. If such a burner is used in large-size furnace chambers with a low wall temperature, e.g. in large hot water boilers, the low temperature in the furnace chamber may also cause a further decrease of the flame temperature, which in turn results in a further delay of the complete combustion of the pulverulent fuel.

U.S. patent specification U.S. Pat. No. 2,335,188 discloses a burner in which the pulverulent fuel is supplied through an annular gap. A burner of this type also suffers from the above-mentioned drawbacks.

British patent specification GB-A No. 2,057,114 discloses another example of a powdery fuel burner in which use is made of an annular nozzle and of ultra-fine pulverized coal as igniting fuel. Since the production of ultra-fine pulverized coal fuels is expensive, the operation of such a burner is costly.

German published application DE-Al No. 2,816,674 is a further example of a burner construction which uses an annular nozzle for obtaining a preheated mixture of pulverized coal and carrier air.

One problem encountered in all burners for burning pulverulent fuels is how to supply the fuel to achieve the acceptable complete combustion. The object of the present invention is to overcome this problem. Another object of the invention is to provide a device which can be used for converting existing oil-fired furnaces to powdery fuel firing. Yet another object of the invention is to provide a burner which can be fired with pulverulent fuels and gaseous or liquid fuels in arbitrary proportions. This and further objects of the invention are achieved by means of a burner which according to the invention is characterized by the features stated in the accompanying main claim. The burner according to the invention thus has a divergent burner quarl at the narrow end of which a pressure liquid or compressed air burner for combustion-assisting gaseous or liquid fuel opens. The feed means for the pulverulent fuel comprise a number of separate discharge passages which are arranged in a ring and which open in the divergent wall portion of the burner quarl at a distance from both the burner nozzle and the inlet for secondary or main combustion air and which are directed obliquely inwardly towards the axis of the burner and are spaced from each other a distance which substantially exceeds the extension of the discharge passages along said ring.

The burner according to the invention thus relies on a combination of a so-called combustion quarl which may be of brickwork design and an auxiliary burner for producing a combustion-assisting flame primarily of fuel oil but also of other liquid fuels or gas. Normally, the combustion air supplied to the burner according to the invention need not be preheated.

The burner according to the invention thus uses a so-called pressure liquid or compressed air burner which has been provided with special means for supplying the pulverulent fuel adjacent the oil or gas nozzle of the burner in such a manner that the pulverulent fuel is directed as concentrated jets obliquely inwardly towards the axis of the burner. According to the invention, the pulverulent fuel should be supplied into that area of the flame of the combustion-assisting burner where said flame normally has been stabilized but before the location where the main combustion air enters into the flame. Such a design gives rapid heating and initiated driving-off of volatile substances from the pulverulent fuel, such that a partly ignited or at any rate most easily ignitable substoichiometric fuel/air mixture exists in the area where the main combustion air is blown in. The entire ignition process takes place in the area of the burner which is surrounded by refractory brickwork withstanding a relatively high operating temperature.

As opposed to many of the above-mentioned known burners, the burner according to the invention operates with a so-called external recirculation of the hot combustion gases before the supply of the secondary or main combustion air. The known burner constructions, e.g. the burner according to GB-A No. 2,118,711, operate with internal recirculation, i.e. the hot gases are conducted inwards towards the centre of the flame. In the burner according to the present invention, it is endeavoured to protect the flame from being admixed with gases from the furnace chamber and the secondary air supply, until it is at least partly ignited or, at any rate, very easily ignitable or self-burning (i.e. self-sustaining).

In a particularly preferred embodiment of the invention the ring of outlets of the discharge passages from the feed means for the pulverulent fuel has been arranged at such a radial distance from the inner end of the divergent wall portion of the burner quarl as corresponds to approximately one third to one fifth of the total radial spacing between the inner and the outer end of the divergent wall portion. By this location and by arranging the outlets of the discharge passages for the pulverulent fuel at a certain distance from each other, the pulverulent fuel suspended in carrier air will be supplied in the form of a number of separate jets. This means, on the one hand, that the powdery jets will penetrate more efficiently into and be turbulently mixed with the combustion-assisting flame and the combustion air and, on the other hand, that the interspace between the different powdery jets allows recirculation of hot gases past the discharge passages for the powdery jets. This gives a more rapid heating of the pulverulent fuel and initiates driving-off of volatile substances therefrom before the main combustion air or secondary air is supplied. This effect becomes the more pronounced if the interspace between the outlets of the discharge passages arranged in a ring, i.e. the mutual spacing between the outlets of the discharge passages along said ring, is at least 1.5 times, preferably twice the extension of each outlet of the discharge passages along the ring.

The burner construction according to the invention has made it possible to perform firing of pulverized fuel with a minimum of combustion-assisting fuel, which is important since the latter fuel is more expensive than the pulverized fuel. Normally, the capacity of the combustion-assisting flame should be minimized, generally not exceeding about 5–10% of the maximum capacity of the burner.

In this context, it should be noted that a relatively large quantity of air is required for pneumatic conveyance of the pulverulent fuel through the feed means 30. At full load, the weight ratio of powder to air may be in the order of 2:1 (at most 5:1). For maintaining a sufficiently high velocity for a fully developed pneumatic conveyance in the so-called lean phase, it is also necessary that the flow of carrier air has a certain velocity, i.e. that the carrier air flow is almost constant irrespective of the amount of powder supplied to the burner. It has been found that this substantial carrier air flow causes difficulties in known powder burners and has prohibited recirculation of hot gases to the ignition area of the combustion-assisting flame if the carrier air has been blown in through an annular gap around the combustion-assisting fuel flame. At worst, the combustion-assisting fuel flame has been extinguished or "blown out" by the carrier air. This drawback of prior art powdery fuel burners has been obviated according to the present invention in that the pulverulent fuel is supplied through a number of separate spaced-apart discharge passages the outlets of which are arranged in a ring. This confers several advantages, namely that the carrier air can always be given a flow velocity required for the pneumatic conveyance and that there is space available for recirculation of the hot combustion gases in the interspaces between the different discharge passages. Further, there is obtained a more efficient penetration of the powdery jets into the combustion-assisting flame and the combustion air, this giving increased turbulence and improved distribution of the pulverulent fuel in the entire burner flame.

One embodiment of a burner according to the present invention will be described in greater detail hereinbelow with reference to the accompanying drawing in which:

FIG. 1 is an axial section of this embodiment of the burner according to the invention, and FIG. 2 is a top plan view of a portion of a burner quarl in this burner.

The burner according to the present invention is designed with an opening in a furnace wall 10. The burner has a so-called windbox 11 with a secondary air inlet 12. A burner quarl 13 is arranged in the windbox. The burner quarl has an inner conically divergent portion 14 and an outer cylindrical portion 15. The burner quarl is provided with an internal refractory lining. At the outer end of the burner quarl, there is a ring of guide vanes 16 which are illustrated only schematically and which serve to conduct the secondary air into an annular refractory inlet device or throat 17 which is spaced from the wall portion 15 of the burner quarl so as to define an annular air inlet gap 18 for secondary air.

At the inner end of the conical portion 14 of the burner quarl 13, there is provided a compressed air burner 20. The compressed air burner 20 is designed in a conventional manner and is surrounded by a primary air box 21 with a primary air inlet 22. The primary air is fed to the compressed air burner in a per se known manner in order to emerge, together with the fuel supplied, as a flame 23 from the head 24 of the compressed air burner. In addition, the burner has been equipped in a per se known manner with an igniter 25 of conventional design and with a photocell device 26 for supervising the firing process.

The parts of the burner hitherto described are conventional in a compressed air burner. According to the invention, the burner has been supplemented with feed means 30 for supplying a pulverulent fuel. In the illustrated embodiment, the pulverulent fuel is supplied as an air-borne suspension which is fed through a supply conduit 31 to an annular distributing manifold 32 from which a number of discharge passages 33 extend. The discharge passages 33 are designed as convergent nozzles the narrow ends of which open at the inner side of and form outlets in the conical wall portion 14 of the burner quarl 13. In the illustrated embodiment, eight discharge passages 33 have been arranged in a ring around the conical wall portion 14 so as to be spaced a certain distance from each other and from the inner narrow end of the conical wall portion 14.

For effecient operation, it has been found most advantageous if the spacing between the outlets of the different discharge passages of the ring is at least 1.5 times and most preferably twice the extension of each discharge passage along the ring. In this context, it has also been found most advisable if the radial spacing between the inner end of the divergent wall portion of the burner quarl and the ring of outlets of the discharge passages corresponds to approximately one third to one fifth of the total radial distance between the inner and the outer end of this divergent wall portion.

As appears from FIG. 1, the conical portion 14 of the burner quarl consists of two separate parts 39 and 40 the latter of which comprises the inner narrow end 41 of the conical wall portion 14. In FIG. 2 there is shown from above (with respect to FIG. 1) an insert baffle 42 which is used for defining the discharge passages 33. When comparing FIGS. 1 and 2, it will be found that the discharge passages 33 have a slit-shaped inlet end 43 at the distributing manifold 32 and a quadrilateral outlet end 44 at the inner side of the conical wall portion 14, the outlet end 44 having a smaller cross-sectional area than the inlet end 43.

The burner according to the invention operates as follows.

Ignition and stabilization of the outflowing oil mist or gas for the combustion-assisting flame take place in the instant compressed air burner construction in the same way as in similar compressed air burner constructions, namely substantially by recirculation of hot combustion gases at the outer side of the ignition area of the flame within the bricked burner quarl. Recirculation of hot combustion gases from the flame 23 thus occurs as indicated by the arrows 36. By supplying the pulverulent fuel through separate discharge passage outlets 44 spaced from each other and directed obliquely inwardly towards the centre axis of the burner, the powdery jets will be directed obliquely inwardly towards the centre axis of the burner and have a small thickness extension, whereby the recirculating hot gases (arrows 36) will be able to pass between the separate pulverized fuel jets 37 and almost as far up as the burner head 24. This effect is best ensured if the mutual spacing between the outlets of the different discharge passages is as stated above. By arranging the ring of outlets from the discharge passages between the primary and secondary air inlets it is further ensured that the flame consisting of combustion-assisting fuel and pulverized fuel is kept together and that the pulverized fuel particles injected in the flame are retained in the hot area of the flame to be combusted in an efficient manner. The best way of achieving this effect is to use the above-mentioned radial spacing between the ring of discharge passages and the inner end of the divergent wall portion.

The major portion of the secondary air is supplied in a known manner through the annular secondary air inlet 18, such that the air will enter substantially as indicated by the arrows 38.

As appears from the embodiment of the invention shown in the drawing, the burner system according to the invention is well suited for converting existing oil-fired furnaces to firing with pulverulent fuels. The only requirement for such a conversion thus is the exchange of the front portion of the burner and the installation of equipment for storing, dispensing and transporting pulverulent fuel, transportation of ash as well as flue-gas filtering. The remaining burner equipment, fans, oil system etc, can be used without any modifications. Furthermore, automatic operation and supervision of the burner can be effected by using available standard automatic control means which are adapted to pulverized coal firing. By designing the combustion-assisting burner as a pressure liquid or compressed air burner, it is possible, if so desired, to fire the furnace with oil or gas only or with a combination of such firing and pulverized fuel firing.

In the illustrated embodiment, the burner quarl 13 consists of a conical wall portion 14 and a cylindrical wall portion 15. However, it is also possible without departing from the spirit and scope of the invention to design these two wall portions as a continuous cup-shaped wall portion the inner side of which extends in an arc from the inner to the outer end. It is also conceivable to completely dispense with the cylindrical wall portion 15 and to dispose the secondary air inlet 18 at the outer edge of the conical wall portion 14.

What I claim and desire to secure by Letters Patent is:

1. A burner for burning a pulverulent fuel, using a combustion-assisting flame produced by means of liquid or gaseous fuel, said burner having a divergent burner quarl (13) proximate the narrow end of which feed means (30) for injecting the pulverulent fuel, a pressure liquid or compressed air burner (20) for combusting the combustion-assisting gaseous or liquid fuel, and a primary air inlet (22) are arranged and proximate the other end of which an inlet (18) for secondary or main combustion air opens, the burner nozzle (24) of said pressure liquid or compressed air burner (20) being disposed at the narrow end of the divergent burner quarl (13), characterized in that the outlet (33) of the feed means (30) for the pulverulent fuel in the divergent burner quarl (13) opens in the divergent wall portion (14) thereof at a distance spaced from both the burner nozzle (24) and from the inlet (18) for secondary or main combustion air and consists of a number of spaced-apart discharge passages (33) arranged in a ring around the burner quarl (13) and directed obliquely inwardly towards the axis of the burner.

2. Burner as claimed in claim 1, characterized in that the mutual spacing of the outlets of the discharge passages (33) along said ring is at least 1.5 times, preferably twice the extension of each outlet of the discharge passages along said ring.

3. A burner for burning a pulverulent fuel, using a combustion-assisting flame produced by means of liquid or gaseous fuel, said burner having a divergent burner quarl (13) proximate the narrow end of which feed means (30) for injecting the pulverulent fuel, a pressure liquid or compressed air burner (20) for combusting the combustion-assisting gaseous or liquid fuel, and a primary air inlet (22) are arranged, and proximate the other end of which an inlet (18) for secondary or main combustion air opens, the burner nozzle (24) of said pressure liquid or compressed air burner (20) being disposed at the narrow end of the divergent burner quarl (13), characterized in that the outlet (33) of the feed means (30) for the pulverulent fuel in the divergent burner quarl (13) opens in the divergent wall portion (14) thereof at a distance spaced from both the burner nozzle (24) and from the inlet (18) for secondary or main combustion air and consists of a number of spaced-apart discharge passages (33) arranged in a ring around the burner quarl (13) and directed obliquely inwardly towards the axis of the burner, said ring of the outlets of the discharge passage (33) of the feed means (30) for the pulverulent fuel is arranged at such a radial distance from the inner end of the divergent wall portion (14) of the burner quarl (13) as corresponds to approximately one third to one fifth of the total radial distance between the inner and the outer end of said divergent wall portion.

4. A burner for burning a pulverulent fuel, using a combustion-assisting flame produced by means of liquid or gaseous fuel, said burner having a divergent burner quarl (13) proximate the narrow end of which feed means (30) for injecting the pulverulent fuel, a pressure liquid or compressed air burner (20) for combusting the combustion-assisting gaseous or liquid fuel and a primary air inlet (22) are arranged and proximate the other end of which an inlet (18) for secondary or main combustion air opens, the burner nozzle (24) of said pressure liquid or compressed air burner (20) being disposed at the narrow end of the divergent burner quarl (13), characterized in that the outlet (33) of the feed means (30) for the pulverulent fuel in the divergent burner quarl (13) opens in the divergent wall portion (14) thereof at a distance spaced from both the burner nozzle (24) and from the inlet (18) for secondary or main combustion air and consists of a number of spaced-apart discharge passages (33) arranged in a ring around the burner quarl (13) and directed obliquely inwardly towards the axis of the burner, and wherein said feed means (30) for the pulverulent fuel comprise an annular distributing manifold (32) from which the discharge passages (33) arranged in a ring extend, and that the cross-sectional inlet area of these discharge passages is larger than the cross-sectional outlet areas thereof, such that the discharge passages are convergent towards their outlet ends.

* * * * *